US009359839B2

(12) United States Patent
Bertelsen

(10) Patent No.: US 9,359,839 B2
(45) Date of Patent: Jun. 7, 2016

(54) VARIABLE DIAMETER PIPE CLAMP APPARATUS AND TORQUE MODULE THEREFORE

(71) Applicant: Jeffrey Lee Bertelsen, Coldspring, TX (US)

(72) Inventor: Jeffrey Lee Bertelsen, Coldspring, TX (US)

( * ) Notice: Subject to any disclaimer, the term of this patent is extended or adjusted under 35 U.S.C. 154(b) by 468 days.

(21) Appl. No.: 13/868,789

(22) Filed: Apr. 23, 2013

(65) Prior Publication Data

US 2014/0311732 A1 Oct. 23, 2014

Related U.S. Application Data

(60) Provisional application No. 61/639,956, filed on Apr. 29, 2012.

(51) Int. Cl.
*E21B 19/16* (2006.01)
*E21B 4/00* (2006.01)

(52) U.S. Cl.
CPC ..... *E21B 19/164* (2013.01); *E21B 4/006* (2013.01)

(58) Field of Classification Search
CPC ... E21B 19/161; E21B 19/164; E21B 19/167; E21B 4/006
See application file for complete search history.

(56) References Cited

U.S. PATENT DOCUMENTS

| | | | | |
|---|---|---|---|---|
| 4,037,672 | A * | 7/1977 | Hodge | 173/157 |
| 6,237,445 | B1 * | 5/2001 | Wesch, Jr. | 81/57.18 |
| 6,412,554 | B1 * | 7/2002 | Allen et al. | 166/80.1 |
| 2012/0137833 | A1 * | 6/2012 | Pettit | 81/57.11 |

* cited by examiner

*Primary Examiner* — Brad Harcourt
(74) *Attorney, Agent, or Firm* — Matthew J. Lattig; Charter IP, LLC

(57) ABSTRACT

A combination for making up and breaking out pipe at an oil rig site includes a torque module and at least one pipe clamp apparatus. The torque module includes a pair of hydraulic motors, a torque transmission driven by the motors, a herring-bone gear segment driven by the transmission to rotate the torque module, and a pair of clamp cylinders actuated by the transmission. The at least one pipe clamp apparatus is actuated by at least one of the clamp cylinders to apply a uniform gripping load around a pipe that is pipe diameter independent.

15 Claims, 7 Drawing Sheets

VARIABLE DIAMETER PIPE CLAMP APPARATUS AND TORQUE MODULE THEREFORE

CROSS-REFERENCE TO RELATED APPLICATION

The present application claims the benefit under 35 U.S.C. §119(e) of U.S. Provisional Patent Application No. 61/639,956 to the inventor, filed Apr. 29, 2012, the entire contents of which is hereby incorporated by reference herein.

BACKGROUND

1. Field

Example embodiments generally relate to a pipe clamp apparatus adapted to automatically adjust to pipes of variable diameters, and a torque module for the pipe clamp apparatus for applying torque thereto.

2. Related Art

Conventionally at an oil rig site, various diameters of piping are used in order to extract fossil fuels deep beneath the earth's crust. Various sections of different diameters are connected via drill collars on the inward direction into the well, as well as on the extraction direction. The time it takes, "connection time", delays extraction of oil and is a significant cost to drillers.

Accordingly, a site will typically have a number of different sized drill slips or drill collars to account for the different diameter piping used; i.e., a different sized drill slip or casing slip is used with each change in pipe diameter. Often this can mean up to 5 to 7 different diameter pipe handling devices such as slips, drill collars, tongs, as well as wasted time changing between these devices or changing the devices to different pipe sizes.

There are two, basic, conventional clamping methods used to hold pipe during torque operations on the pipe. The pipe is torqued at every tool joint or pipe joint, and a joint is present on drill pipe at about every thirty feet; thus requiring a torque operation at every joint. Drilling operations typically range from about 10,000 to 20,000 in depth, so hundreds of these torque operations are performed during the drilling process. The pipe must be clamped each time a torque operation is performed thereon.

One clamping method employs two clamp dies, one clamp die located on each side of the pipe in a holder. This design applies all of the force in a small area about 1" by 5" on either side of the pipe; if the applied force is too high in this small area it will cause the pipe to become deformed, or "egg-shaped", damaging the pipe.

The second conventional clamping method employs three (3) fixed clamp dies located in a holder set at a static mid-range radius in an effort to try and clamp different diameter pipes and distribute the force over a greater area. On pipe having a smaller diameter (and hence smaller radius), and due to the preset radius of the dies in the holder, the smaller pipe only makes contact on the inside edge of the clamp dies only. Conversely, if the pipe diameter (and hence radius) is larger, the outside dies in the clamp holder will contact on the outside edge only. This becomes an issue, as pressure is not distributed evenly on the clamps during the torque operations.

In both design cases, if the pipe diameter changes, inserts must be either added or removed from the fixed jaw clamps in an effort to compensate for the radius change effect. Further, as the clamps provide only two points of pressure on the pipe, and not a uniform pressure, there is the possibility of slippage and/or deformation of the pipe under intense forces (typically in upwards of 100,000 ft-lbs) applied by the clamps to hold the pipe in place.

Conventionally, the torque applied to these clamps is by way of a cylinder located in a torque module. The cylinder design is used to rotate the clamp device. This torque system is limited to 32 to 37 degrees of rotation maximum. This is due to what is known as a cam over effect caused by the use of a cylinder. A cam over effect can be understood where as the cylinder pushes around the arc rotating the pipe, typically about an arc of around 37 degrees, the cylinder can no longer be returned to its starting point. The cylinder will attempt to come straight across the arc and not follow the arc when it is returned. This conventional cylinder design in the torque module is also limited to rotate or work one sided, i.e. it cannot go both clockwise (CW) and counter-clockwise (CCW) from a neutral position, only CW or CCW only-one direction. This limitation will cause what is referred to as the "breakout operation" (i.e., disconnect) to be a two-step process instead of a single step. To breakout, the conventional torque module with cylinder initially has to rotate to 35 degrees, then the clamp is applied to the pipe, and finally the clamped pipe under torque is rotated back. This two step process takes twice as long. Moreover, the 37 degree limitation can also cause the torque process to require multiple movement steps, as a rotation may require greater than a 37 degree movement on the pipe with the clamp.

SUMMARY

An example embodiment is directed to a pipe clamp apparatus for making up and breaking out pipe at an oil rig site. The apparatus includes a main body section, a set of left and right articulating fingers on either side of the main body section, the left and right fingers pivotable in relation to the main body section, and a pusher bar supporting each of the main body section and left and right articulating fingers. Each of the main body section, left and right articulating fingers include a pipe die thereon for providing a roughened surface for gripping a portion of a pipe. The pusher bar moves forward to engage the main body section and left and right fingers toward a pipe for a first contact to a pipe surface by the pipe die of the main body section, with the articulating left and right fingers pivotable around the pipe for a second contact to the pipe surface by the pipe dies of the left and right articulating fingers so as to apply a uniform gripping load around the pipe that is pipe diameter independent. The pipe clamp apparatus is configured to automatically adjust to pipe diameters in a range of between 4" to 10"

Another example embodiment is directed to a combination for making up and breaking out pipe at an oil rig site. The combination includes a torque module and at least one pipe clamp apparatus. The torque module includes a pair of hydraulic motors, a torque transmission driven by the motors, a herringbone gear segment driven by the transmission to rotate the torque module, and a pair of clamp cylinders actuated by the transmission. The at least one pipe clamp apparatus is actuated by at least one of the clamp cylinders to apply a uniform gripping load around a pipe that is pipe diameter independent, and is configured to automatically adjust to pipe diameters in a range of between 4" to 10".

Another example embodiment is directed to a combination for making up and breaking out pipe at an oil rig site. The combination comprises a torque module and a pipe clamp apparatus. The torque module includes a pair of hydraulic motors, a torque transmission driven by the motors, a herringbone gear segment driven by the transmission to rotate the torque module up to 52 degrees clockwise or counterclockwise from a neutral position in a continuous, operation, and a pair of clamp cylinders actuated by the transmission. The pipe clamp apparatus is actuated by at least one of the clamp cylinders to apply a uniform gripping load around a pipe, and is configured to automatically adjust to pipe diameters in a range of between 4" to 10".

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As to be described hereafter, an example embodiment is directed to a pipe clamp apparatus adapted to automatically adjust to pipes of variable diameters, and a torque module for the pipe clamp apparatus for applying torque thereto.

As to be shown hereafter, the pipe clamp apparatus may be used to torque pipe, hold pipe, move pipe, and/or handle pipe. The pipe clamp apparatus is configured so as to automatically adjust to any desired range of pipe diameters, unlike existing pipe clamps which must utilize inserts and/or change out the dies to account for changing pipe diameters. In one example, the pipe clamp apparatus may automatically adjust to pipe having a diameter in a range of about 4" to 10" in diameter pipe, to be torqued up to about 150,000 ft-lb' via the example torque module to be described hereafter. Accordingly, the example clamp apparatus offers a variable radius clamp design to enable an operator to change pipe diameters without changing clamp dies, while still maintaining a uniform clamping area and clamping pressure around the pipe.

The example torque module to be described hereafter is not subject to the limitation of the conventional cylinder torque module. The use of hydraulic motors and a gear train affords the torque module described hereafter a much small footprint with greater torque (150,000 ft-lbs), the ability to move in either direction from a 0 angle position (CW, CCW) up to 52 degrees of rotation.

Figure 2:
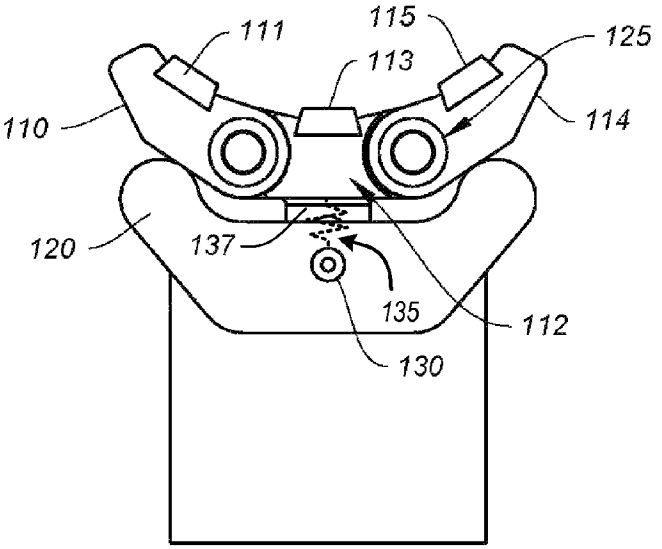
FIG. 2 is front plan view of the apparatus in FIG. 1.
Figure 3:
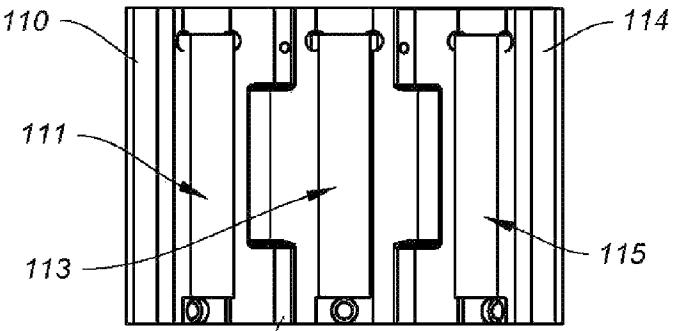
FIG. 3 is a top plan view of the apparatus in FIG. 1.
Figure 1:
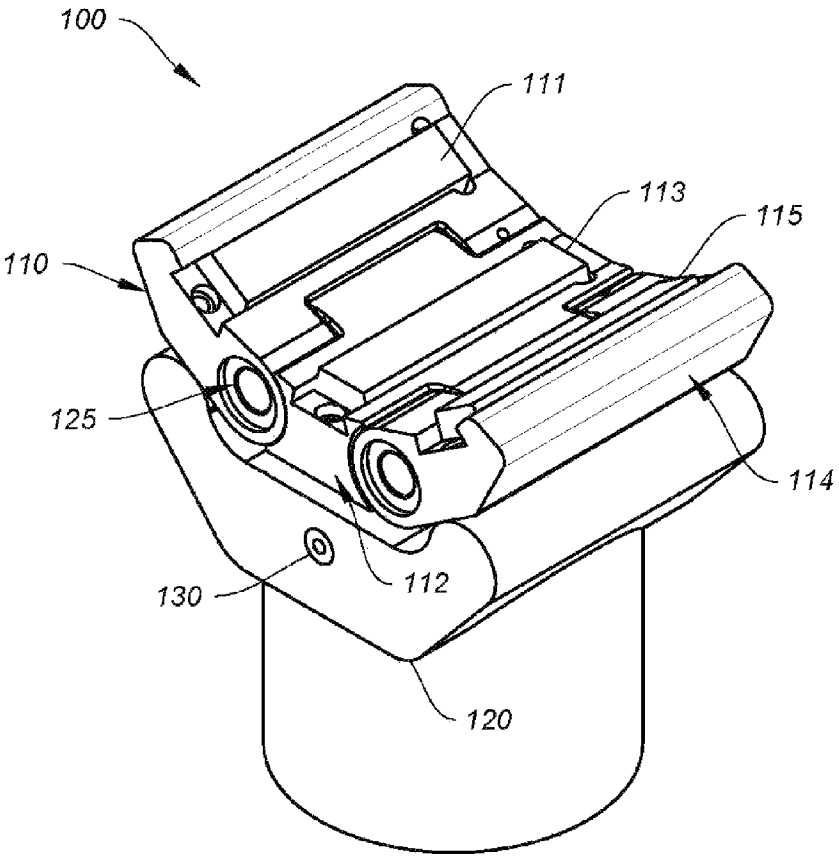
FIG. 1 is a perspective view of a variable diameter pipe clamp apparatus according to an example embodiment.

FIG. 1 is a perspective view of a variable diameter pipe clamp apparatus according to an example embodiment; FIG. 2 is front plan view, and FIG. 3 a top plan view of the apparatus in FIG. 1. Referring to FIGS. 1-3, clamp apparatus 100 includes a main body section 112, articulating left finger 110 and articulating right finger 114, each finger 110, 114 of which are pivotable or articulatable in relation to the main body section 112, and each of main body section 112, articulating left finger 110 and articulating right finger 114 being supported on a pusher bar 120. The main body section 112 and each finger 110 and 114 include a corresponding pipe die 111, 113, 115 thereon. The pipe dies 111,113,115 provide a roughened gripping surface to the pipe for the fingers 110, 114 and main body section 112, and can be serrated or notched in appearance.

The pusher bar 120 is used to move the left and right fingers 110, 114 in changing the radius of the clamp apparatus 100. To do this there is a back body spring 135 (shown in dotted line phantom in FIG. 2) located between the main body section 112 and the pusher bar 120. The back body spring 135 is located inside of the pusher bar 120 at the base of a center section post 137. By locating back body spring 135 here, a seal can be used between the center section post 137 and pusher bar 120 to keep out dirt and cutting fluids that could damage the spring 135.

The clamp apparatus 100 also includes additional springs that keep the fingers 110, 114 biased in an open or neutral position. Torsion springs 125 biases open the fingers 110 and 114, and the back body spring 135 maintains a half-inch clearance between the pusher 120 and main body section 112, riding on a pin 130. Torsion springs 125 may be set to 100 ft-lbf, and back body spring 135 may be set to 400 ft-lbf.

Accordingly, the springs 125, 135 enable the clamp apparatus 100 to always remain in the open position when not under tension by a pipe. The torsion springs 125 maintain the fingers 110, 114 in an open position until the pusher bar 120 moves forward to close them. The back body spring 135 keeps the main body section 112 moved forward, maintaining the gap between the main body section 112 and pusher bar 120.

Figure 4:
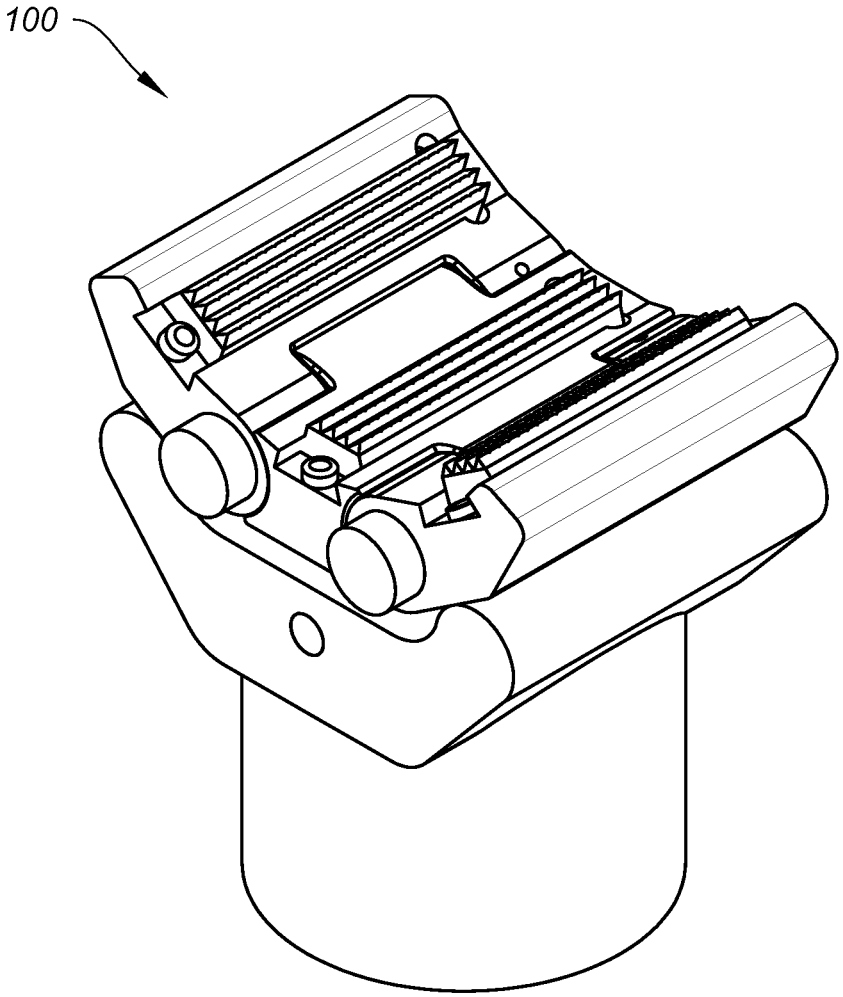
FIG. 4 is a perspective view of a prototype of the clamp apparatus to show constituent components in more detail.
Figure 5:
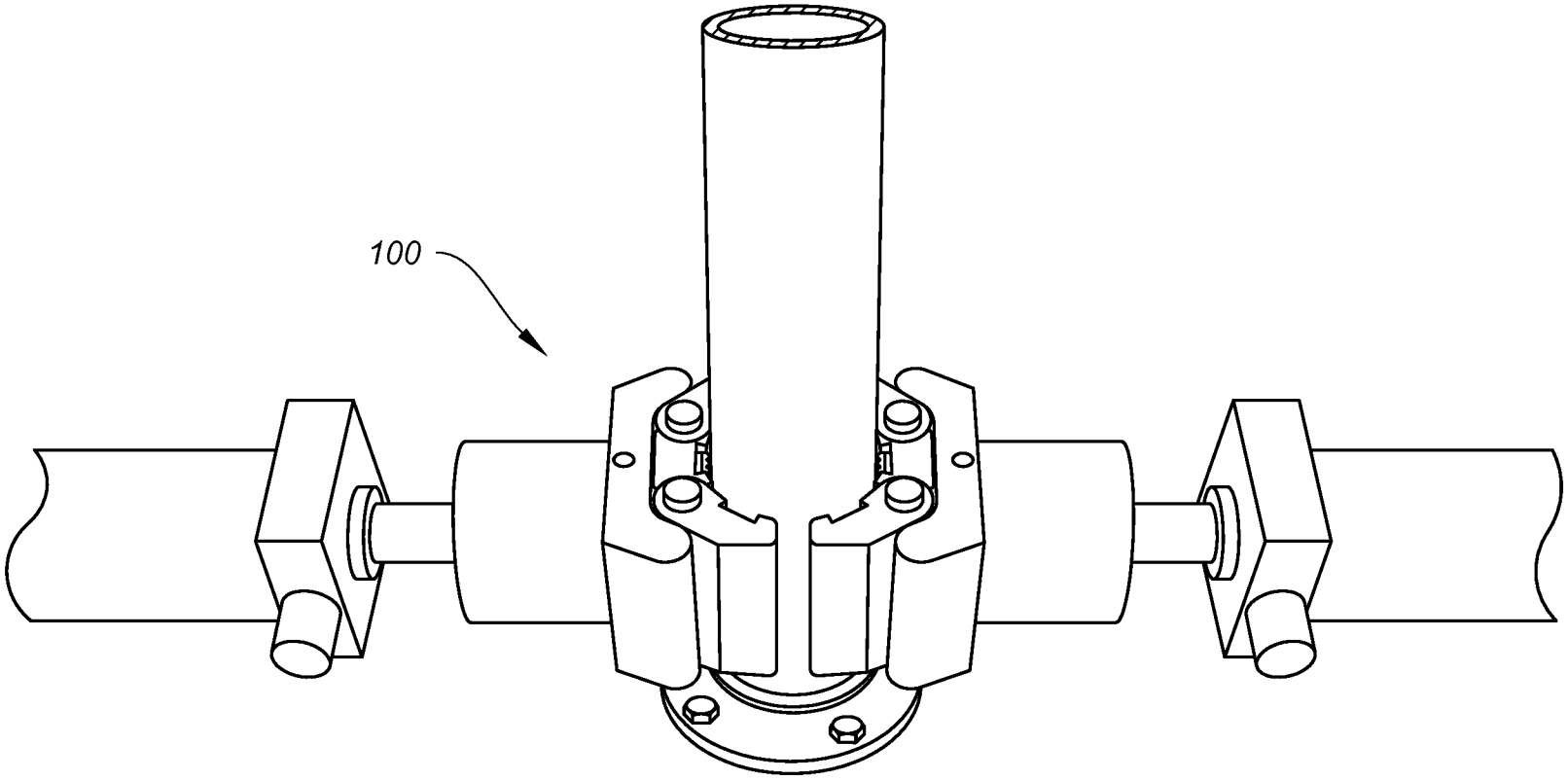
FIG. 5 is a perspective view of the clamp apparatus installed on a 5½ diameter pipe with a conventional cylinder torque module applying torque.
Figure 7:
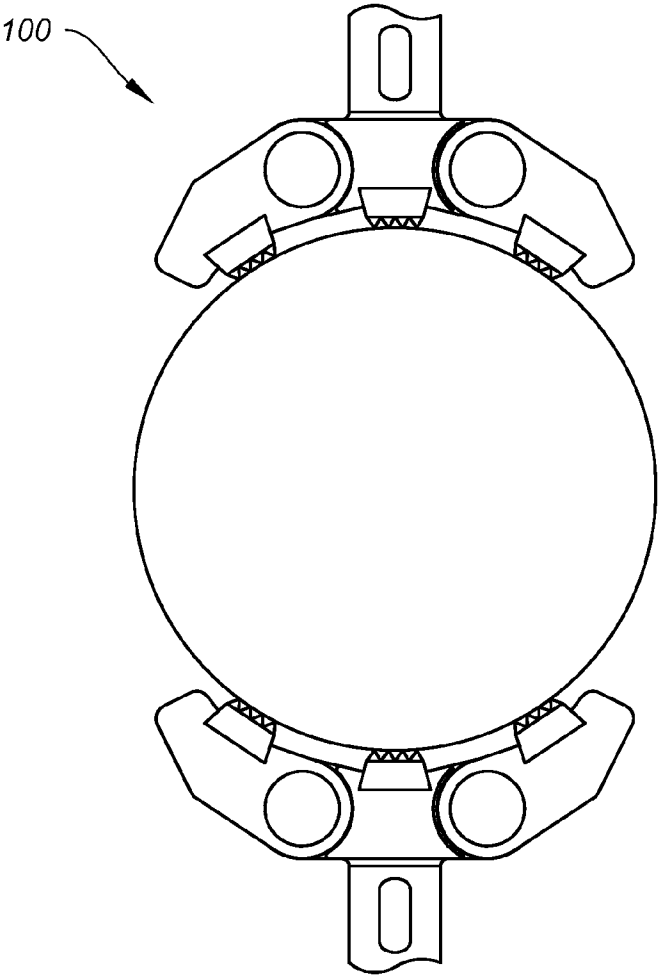
FIG. 7 is a top view of the clamp apparatus installed on a 10" diameter pipe chunk.
Figure 6:
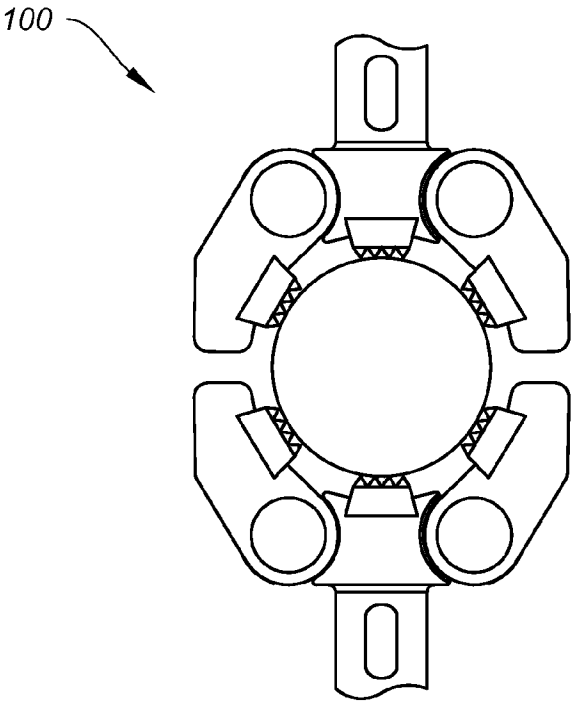
FIG. 6 is a top view of the clamp apparatus installed on a 4" diameter pipe chunk.

FIG. 4 is a perspective view of a prototype of the clamp apparatus to show constituent components in more detail; FIG. 5 is a perspective view of the clamp apparatus installed on a 5½" diameter pipe with a conventional cylinder torque module applying torque; FIG. 6 is a top view of the clamp apparatus installed on a 4" diameter pipe chunk; and FIG. 7 is a top view of the clamp apparatus installed on a 10" diameter pipe chunk.

An example adjustable range of pipe diameter for the clamp apparatus is between about 4.0" pipe diameter to 10.0" diameter pipe. FIG. 4 shows the serrations or roughened surfaces on the pipe dies. Referring to FIGS. 5-7, apparatus 100 will automatically adjust to any pipe diameter in that range, although it may be adjusted to handle pipe diameter outside that diameter range. In operation, the fingers 110, 112, 114 and dies 111, 113, 115 are designed to grip the pipe with equal force, thereby providing six equal points of pressure on a pipe side.

An example closer sequence of operation for clamp apparatus 100 is as follows: (a) the "gorilla" fingers 110, 114 will move toward the pipe by way of a cylinder attached to the pusher bar 120 (there could be 2, 3 or 4 sets of fingers, in the example of FIGS. 5-7, two sets are used); (b) the main body section 112 will hit the pipe first, then stop; (c) the pusher bar 120 will continue to move forward.

The pusher bar 120 moving forward will then (d) cause the fingers 110, 114 to wrap around the pipe and main body section 112 will maintain contact. This contact or movement will act like a stretching or pulling motion around the pipe. This is caused by the movement of the pusher bar 120 and due to the unique angle on the back of the fingers 110, 114 and how the force from the pusher bar 120 is applied. This clamping motion is like using a chain around the pipe and provides the user a distributed clamping force around the pipe with an automated feature to change pipe diameters automatically. This unique pulling process will cause a uniform gripping load around the pipe that is diameter independent. When (e) the clamp apparatus 100 is released, the fingers 110, 114, main body section 112 and pusher bar 120 will return to their fully open position under spring 125, 135 pressure, and the process can be repeated.

Accordingly, a first contact with the pipe is made by the main body section 112, then as the pusher bar 120 continues to move forward, the articulating nature of fingers 110, 114 envelopes the pipe in a second contact, providing a uniform gripping load around the pipe with the dies 111, 113, 115 in contact with the pipe surface.

Figure 8:
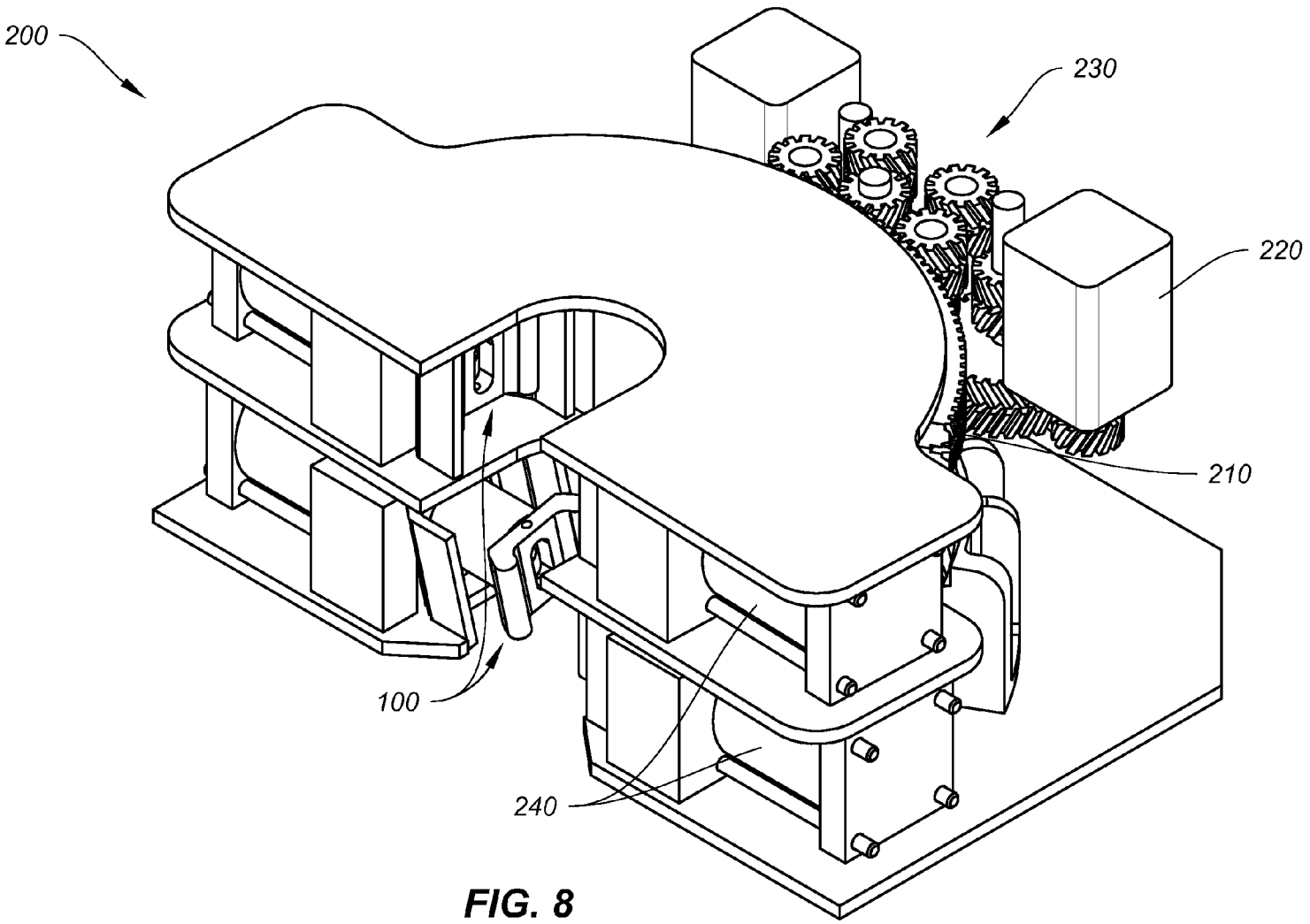
FIG. 8 is a front perspective view of a hydraulic torque module for driving the clamp apparatus according to an example embodiment.
Figure 9:
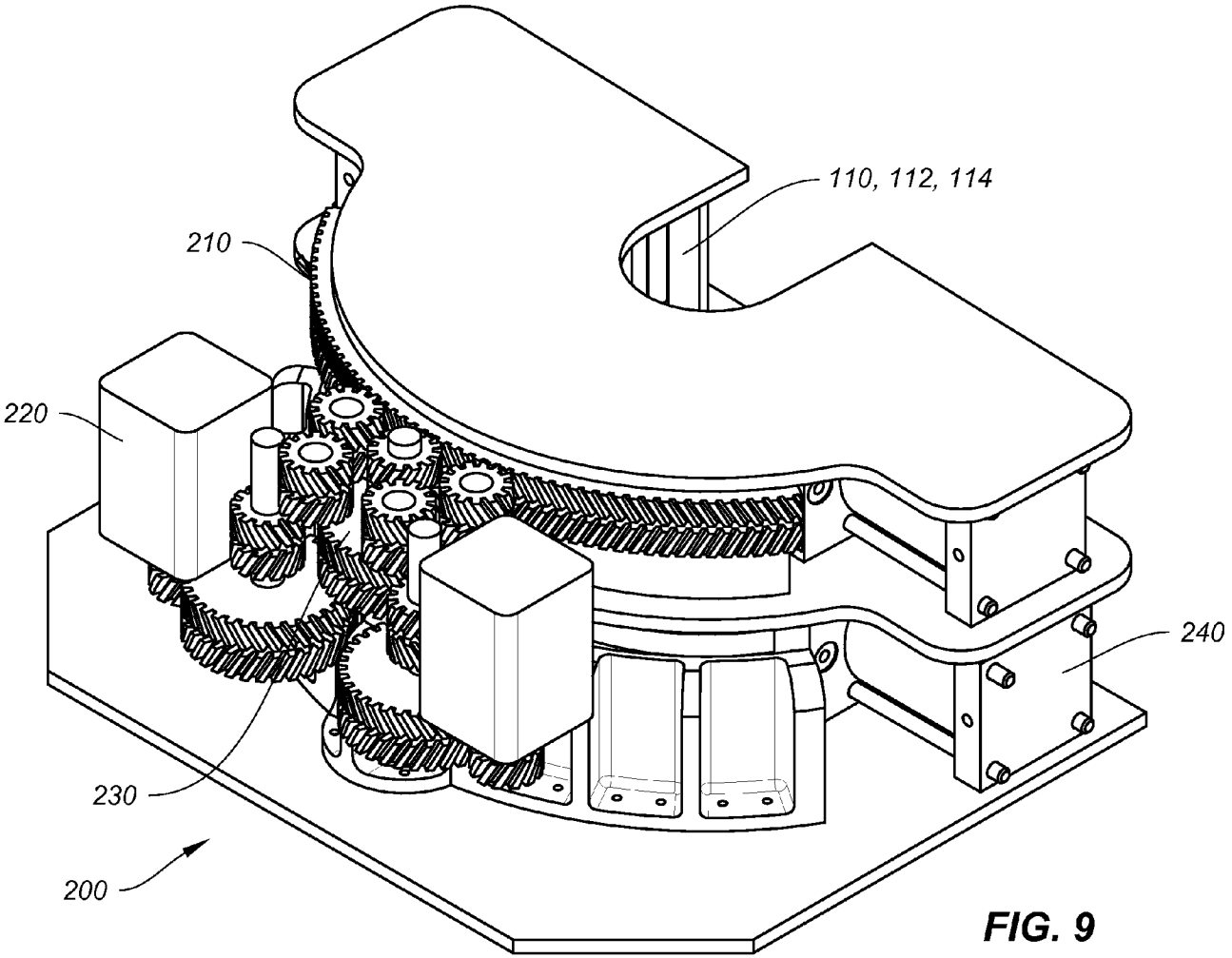
FIG. 9 is a rear perspective view of the hydraulic torque module of FIG. 8
Figure 10:
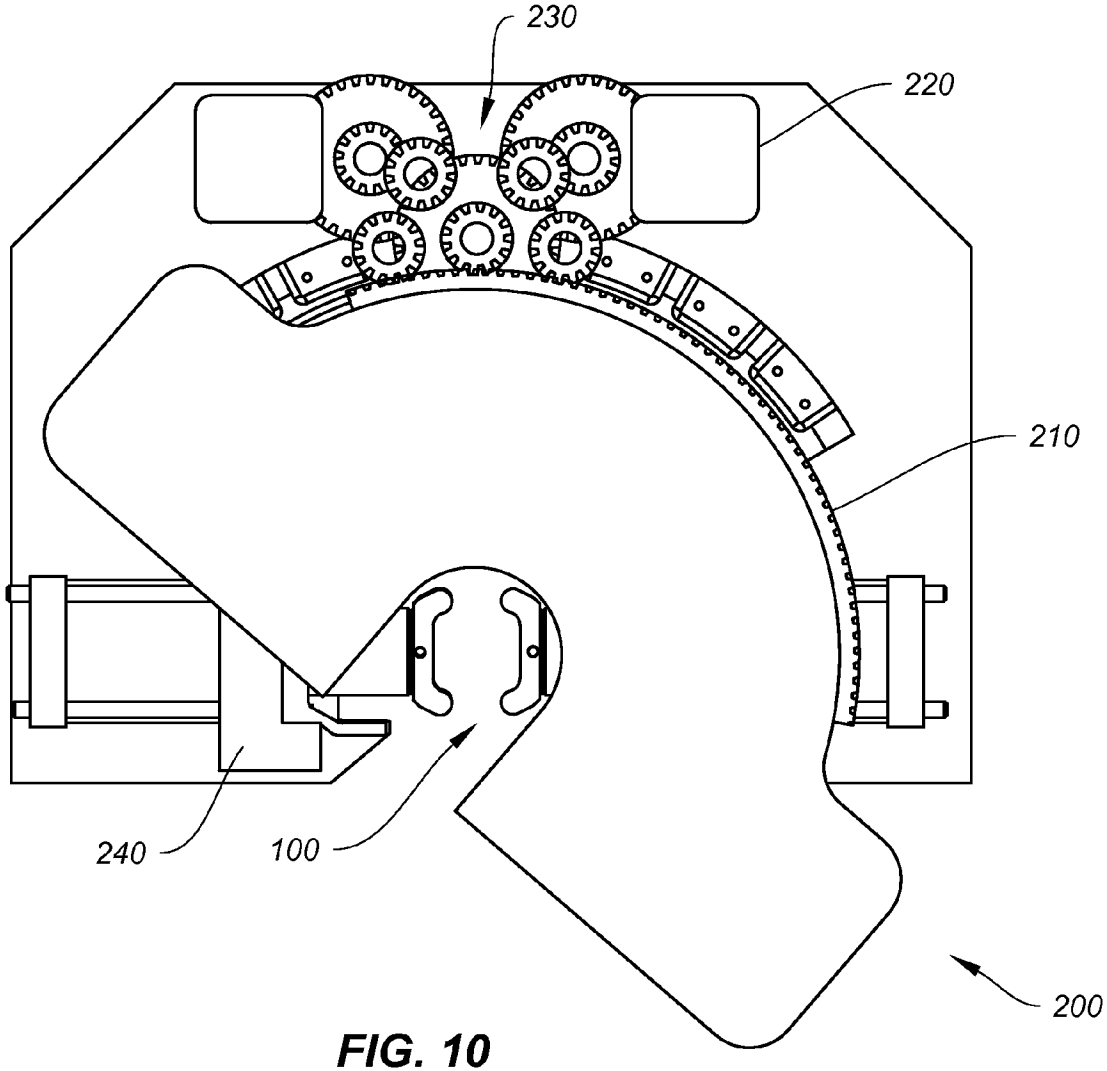
FIG. 10 is a top plan view of the hydraulic torque module of FIG. 8 at 50 degrees of rotation.

FIG. 8 is a front perspective view of a hydraulic torque module 200 for driving the clamp apparatus 100 according to an example embodiment, FIG. 9 is a rear perspective view, and FIG. 10 a top plan view of the hydraulic torque module of FIG. 8 at 50 degrees of rotation from a neutral position. Referring to FIGS. 8-10, the hydraulic torque module 200 ("torque module 200") in general employs two high torque motors and gears to achieve high torque values. The design described hereafter also measures the actual torque at the pipe using a load cell. All other conventional torque module designs use the hydraulic pressure to calculate the torque. The example design improves accuracy because it measures the actual torque, rather than employing a calculated torque. Due to the fact that the torque is applied 90 degrees to the gear drive, the pressure can be measured to give an accurate reading of the torque. This measurement can be recorded and stored as a record of every tool joint (pipe). To do this, a small transducer (serving as the load cell) is added to the torque module 200 and the low voltage data is sent to a recorder.

The torque module 200 may be used to drive the clamp assembly 100 toward a pipe, without the limitations of a cylinder torque module. As shown, the torque module 200 includes a 24" herringbone gear segment 210 which is driven by a torque transmission 230 under control of a pair of hydraulic torque motors 220. The transmission 230 actuates clamp cylinders 240 which apply torque to the clamp apparatus 100 that are connected to pistons thereof, as best shown in FIGS. 8 and 10.

Accordingly, the torque module 200 uses a hydraulic motor design to apply torque, and unlike the conventional cylinder design, which suffers from a cam over effect of the linkage, is not limited to a single direction rotation and an angular limitation from 0 of 37 degrees. The torque module 200, because of its torque motor design, can rotate up to 52 degrees CW or CCW from a neutral position. This allows the operator to make up the drill pipe or breakout the drill pipe from a neutral position, saving a significant amount of time.

Moreover, the torque applied to the clamp apparatus 100 can be accomplished in a single motion; this is significant in that it will not take two or more setups as in the conventional process utilizing conventional cylinder torque module designs as shown in FIG. 5 for example, increasing the process speed. This allows for a much small design with more torque. Therefore, the use of tandem hydraulic motors to drive a gear train (transmission 230) will provide or generate up to 150,000 ft-lbs of torque. From start at a 0 position, a clamp apparatus 100 can be rotated in a continuous step process CW or CCW up to 52 degrees, to either torque or un-torque drill pipe.

Accordingly, and unlike the conventional torque module with cylinder design and its 37 degree of single direction rotation limitation, the torque module 200 employs a torque motor design that can rotate up to 52 degrees CW or CCW from a neutral position. This allows the operator to make up the drill pipe or breakout the drill pipe from a neutral position. This saves time. Additionally, by rotating 52 degrees, the process can be limited to a single step operation, avoiding the two step process for breakout necessitated by the conventional cylinder design. Further, by achieving a uniform clamping area, combined with not having to change pipe handling devices to account for a change in pipe diameter, and having the ability to torque 52 degrees CW or CCW, results in a substantial reduction in connection time for the operator time while minimizing pipe damage.

By automatically adjusting to different pipe diameters, the example pipe clamp apparatus 100 can be adapted to numerous applications during a pipe handling process. For example, and as previously noted, various sized drill slips must be on hand depending on drill collar size when shifting between pipe diameters. The principals of the example embodiments may be applied to a variable diameter drill pipe slip or casing slip, i.e., a footprint that could be implemented to automatically adjust to variable diameter drill collars/piping.

Additionally, these same principles could be applied to pipe-handling systems, to provide a handling system which can automatically adjust to changing pipe diameters such as to drastically cut down on connection time at the well. The example clamp apparatus 100 and torque module 200 thus may be applicable to pipe slips, drill collar slips, pipe handlers, safety clamps, etc. In another example, the clamp apparatus 100 could be used with insert slot designs in slips to make repeatable and allow the manufacturer the ability to be able to rate slips, something heretofore which has not been contemplated in the industry.

The example embodiments being thus described, it will be obvious that the same may be varied in many ways. Such variations are not to be regarded as departure from the example embodiments, and all such modifications as would be obvious to one skilled in the art are intended to be included in the following claims.

What is claimed:

1. A pipe clamp apparatus for making up and breaking out pipe at an oil rig site, comprising:

a main body section, a set of left and right articulating fingers on either side of the main body section, the left and right fingers pivotable in relation to the main body section, and a pusher bar supporting each of the main body section and left and right articulating fingers, each of the main body section, left and right articulating fingers including a pipe die thereon for providing a roughened surface for gripping a portion of a pipe, the pusher bar moving forward to engage the main body section and left and right fingers toward a pipe for a first contact to a pipe surface by the pipe die of the main body section, with the articulating left and right fingers pivotable around the pipe for a second contact to the pipe surface by the pipe dies of the left and right articulating fingers so as to apply a uniform gripping load around the pipe that is pipe diameter independent wherein the pipe clamp apparatus is configured to automatically adjust to pipe diameters in a range of between 4" to 10".

2. The pipe clamp apparatus of claim 1, wherein the second contact occurs after the first contact.

3. The pipe clamp apparatus of claim 1, wherein the pipe clamp apparatus remains in a biased open position when not under tension of the pipe.

4. The pipe clamp apparatus of claim 1, further comprising a pair of torsion springs which bias the left and right articulating fingers in an open position when the clamp apparatus is not under tension of a pipe.

5. The pipe clamp apparatus of claim 1, further comprising a back body spring between the main body section and the pusher bar to maintain a ½" clearance there between.

6. A combination for making up and breaking out pipe at an oil rig site, comprising:

a torque module, the torque module including:

a pair of hydraulic motors, a torque transmission driven by the motors, a herringbone gear segment driven by the transmission to rotate the torque module, and a pair of clamp cylinders actuated by the transmission, and at least one pipe clamp apparatus actuated by at least one of the clamp cylinders to apply a uniform gripping load around a pipe that is pipe diameter independent wherein the at least one pipe clamp apparatus is configured to automatically adjust to pipe diameters in a range of between 4" to 10".

7. The combination of claim 6, wherein the pipe clamp apparatus further includes a main body section, a set of left and right articulating fingers on either side of the main body section, the left and right fingers pivotable in relation to the main body section, and a pusher bar supporting each of the main body section and left and right articulating fingers the pusher bar moving forward under power of a clamp cylinder to engage the main body section and left and right fingers toward a pipe for a first contact to a pipe surface by the main body section, with the articulating left and right fingers pivotable around the pipe for a second contact to the pipe surface so as to apply a uniform gripping load around the pipe that is pipe diameter independent.

8. The combination of claim 7, wherein the second contact occurs after the first contact.

9. The combination of claim 7, wherein each of the main body section, left and right articulating fingers including a pipe die thereon for providing a roughened surface for gripping a portion of the pipe.

10. The combination of claim 6, wherein the torque module is configured to rotate up to 52 degrees clockwise or counterclockwise from a neutral position.

11. The combination of claim 6, wherein the 52 degree rotation is done in a continuous, unbroken step operation.

12. The combination of claim 6, wherein the torque module is configured to provide up to 150,000 ft-lbs of torque.

13. A combination for making up and breaking out pipe at an oil rig site, comprising:

a torque module, the torque module including:

a pair of hydraulic motors, a torque transmission driven by the motors, a herringbone gear segment driven by the transmission to rotate the torque module up to 52 degrees clockwise or counterclockwise from a neutral position in a continuous operation, and a pair of clamp cylinders actuated by the transmission, and a pipe clamp apparatus actuated by at least one of the clamp cylinders to apply a uniform gripping load around a pipe, the pipe clamp apparatus being configured to automatically adjust to pipe diameters in a range of between 4" to 10".

14. The combination of claim 13, wherein the torque module further includes a load cell employed to measure actual torque at the pipe.

15. The combination of claim 13, wherein the torque module hydraulic motors are configured to drive the torque transmission so as to provide up to 150,000 ft-lbs of torque.

* * * * *